United States Patent [19]

Alexandrovich et al.

[11] Patent Number: 4,681,828

[45] Date of Patent: Jul. 21, 1987

[54] METHOD OF CHEMICAL ELECTROGRAPHIC IMAGE AMPLIFICATION USING CHEMICALLY ACTIVE TONER PARTICLES

[75] Inventors: Peter S. Alexandrovich; Joseph W. Manthey; John W. May; Chandra Sreekumar, all of Rochester, N.Y.

[73] Assignee: Eastman Kodak Company, Rochester, N.Y.

[21] Appl. No.: 902,727

[22] Filed: Sep. 2, 1986

[51] Int. Cl.[4] ..... G03G 13/22

[52] U.S. Cl. ..... 430/97; 430/106; 430/354; 430/109; 430/110

[58] Field of Search ..... 430/97, 354

[56] References Cited

U.S. PATENT DOCUMENTS

| | | | |
|---|---|---|---|
| 3,083,117 | 3/1963 | Schmiedel et al. | 117/17.5 |
| 3,373,019 | 3/1968 | Bixby | 430/109 |
| 3,508,823 | 4/1970 | Gundlach et al. | 355/3 |
| 3,840,385 | 10/1974 | Yoskida | 430/109 |
| 3,880,656 | 4/1975 | Nagashima et al. | 96/1.2 |
| 4,075,019 | 2/1978 | DoMinh | 96/88 |
| 4,131,463 | 12/1978 | Tamboi et al. | 96/1 E |
| 4,148,968 | 4/1979 | Nagashima et al. | 428/454 |
| 4,171,221 | 10/1979 | DoMinh | 96/48 |
| 4,201,588 | 5/1980 | Fleming et al. | 430/167 |
| 4,247,625 | 1/1981 | Fletcher et al. | 430/336 |
| 4,307,168 | 12/1981 | Kaukeinen et al. | 430/97 |
| 4,308,341 | 12/1981 | DoMinh | 430/336 |

OTHER PUBLICATIONS

Research Disclosure #16235, Oct., 1977, pp. 15–17.
Research Disclosure #14719, Jul. 1976, p. 14.

*Primary Examiner*—J. David Welsh
*Attorney, Agent, or Firm*—Robert A. Gerlach

[57] ABSTRACT

A method of forming an image is disclosed in which chemically active toner particles are used to trigger image amplification chemistry after their attraction to an electrostatic charge pattern.

The method of forming an image comprises applying electrographic toner particles to a charge pattern on a support followed by a chemical amplification processing step comprising heating the toner image in the presence of an image-receiving element comprising:

(a) a cobalt(III) complex capable of releasing an amine on processing, and (b) an amplifier which, on reaction with an amine:

(i) forms a dye or dye precursor, or (ii) reduces the cobalt(III) complex, resulting in the release of additional amine, said toner comprising an activator which, under the conditions of processing releases an amine either directly or indirectly.

17 Claims, 1 Drawing Figure

METHOD OF CHEMICAL ELECTROGRAPHIC IMAGE AMPLIFICATION USING CHEMICALLY ACTIVE TONER PARTICLES

FIELD OF THE INVENTION

This invention relates to electrography and more specifically to methods for amplifying electrographic toner images.

BACKGROUND OF THE INVENTION

Image-forming processes in which electrographic toner is attracted to latent electrostatic charge patterns are well-known in the art.

A fundamental limitation of conventional toning systems is the limitation of image amplification gain. When electrographic toning and optical density formation occur simultaneously, density delivered per electrostatic charge unit cannot be increased without limits. A practical upper value for density deliverable per charge is the primary reason that the photographic speed of conventional electrophotographic systems have been limited to about two orders of magnitude less than that of silver halide systems.

In the past, there have been efforts to form images by developing an electrostatic latent image with a developer containing a reactant and then, through suitable chemical image transfer to a receiver, reacting this chemical image with another reactive substance to form a colored reaction product, such as a dye. For example, U.S. Pat. No. 3,508,823 describes a method for forming an image by heating toners containing dithiooxamide compounds in the presence of a receiver element containing a cobalt salt. However, there is no apparent increase or amplification of photographic speed in those processes involving reactive toners which are made visible in subsequent color forming reactions.

U.S. Pat. No. 4,171,221 describes photosensitive elements comprising a cobalt(III) complex and a chelating compound which elements may be imagewise photoexposed and processed by heating. This produces a visible image by a sequence of steps exhibiting an "internal gain"-that is to say that the amount of image dye produced is greater than that predicted from the number of photons received during photoexposure. Among the disclosed chelating compounds, there may be mentioned 1-(2-pyridylazo)-2-naphthol (PAN) and 4-(2-pyridinylazo)-1,3-benzenediol (commonly referred to as pyridylazoresorcinol or simply PAR). The image-forming reaction is triggered by a photoactive compound, for example a photoreductant which provides cobalt(II) ions to the system.

U.S. Pat. No. 4,201,588 describes photosensitive elements having a radiation-sensitive layer capable of generating an amine. The layer contains a reducible cobalt(III) complex containing ammine or amine ligands and a photoreductant. The released amine is then reacted with another compound in an image-recording layer to form a visible image. An example of such an image-recording layer is a diazo layer coated on a separate support which is laminated to the exposed photosensitive element and heated to form an azo dye image. Among other amine-sensitive image-forming compounds specified is o-phthalaldehyde. This image is formed by phthalaldehyde-cobalt(III) complex-quinone (PACQ) chemistry which again displays internal gain because ammonia is released during dye formation and is then available to be recycled for further dye formation.

U.S. Pat. No. 4,307,168 describes a process in which an electrographic image is formed using a toner whose particles contain a catalyst comprising a metal of Group (VIII) or (IB) of the Periodic Table. The toner image is then amplified using a high gain chemical redox amplification composition. In Example 12 the toner particles are doped using a cobalt(II) compound. The toner image is amplified by heating in contact with a processing sheet containing cobalt(III) tris(ethylenediamine)-trifluoroacetate and pyridylazoresorcinol. (The reference in this Example to "cobalt(II)" at column 18, line 16 is an obvious error especially in view of the reference to Research Disclosure Item 14614 referred to at column 18, lines 18–19. It should read "cobalt(III)".) By way of summary it can be said that the cobalt-/pyridylazoresorcinol reaction is triggered directly by cobalt(II) ions.

SUMMARY OF THE INVENTION

The present invention comprises the method and materials for use in two-stage amplification of electrographic latent images using amplifier-cobalt(III) complex chemistry. Electrographic toners containing an activator are used in the first stage of amplification to develop low voltage differential images. The second stage comprises thermographic development, for example, in which a toned photoconductor and an amplifier-cobalt(III) complex receiver are sandwiched in heated rollers. High density, high contrast dye images of crisp definition are produced, in which dye is formed imagewise where toner contacts the amplifier-cobalt(III) complex receiver. Liquid or dry first-stage toners can be used. Active toners are capable of producing D-max from a voltage differential of less than 5 volts.

According to the present invention there is provided a method of forming an image which comprises applying electrographic toner particles to a charge pattern on a support followed by a chemical amplification processing step comprising heating the toner image in the presence of an image-receiving element comprising:

(a) a cobalt(III) complex capable of releasing an amine on processing, and (b) an amplifier which, on reaction with an amine:

(i) forms a dye or dye precursor, or (ii) reduces the cobalt(III) complex resulting in the release of additional amine, said toner comprising an activator which, under the conditions of processing, releases an amine either directly or indirectly.

Both liquid and dry toners are useful in the practice of the present invention, as long as the requisite activator is present in the toner. Useful amplifier-cobalt(III) complex image-receiving elements may either be an integral part of the element which is toned, or they may be separate therefrom, as will be explained in more detail hereinafter.

The present invention has a number of advantages over the prior art. For instance, while the present amplification process is similar to that described for the photoactivated materials described n U.S. Pat. No. 4,201,588, the present process is more efficient by several orders of magnitude, as demonstrated in Example 14. In addition, no photoreductant is required in the present method, as it is in U.S. Pat. No. 4,201,588.

The receiver elements of the present invention are superior to the one described in Example 12 of U.S. Pat.

No. 4,307,168. One problem with the element of the type disclosed in U.S. Pat. No. 4,307,168 is that it comprises cobalt(III) complex in thermodynamic equilibrium with a corresponding cobalt(II) compound. This results in storage problems because unless the processing element is stored under refrigeration, the cobalt(II) will trigger the cobalt/PAR reaction (see reaction Scheme 2, described hereinafter) during storage to produce red dye thus causing background stain. The elements described in U.S. Pat. No. 4,171,221 suffer from this same disadvantage. On the other hand, the amplifier-cobalt(III) complex image-receiving elements of the present invention do not contain trigger molecules nor do they contain photoreductants. Hence their shelf life is vastly longer and no fogging occurs at room temperature in any reasonable time span.

Another advantage of the present invention over U.S. Pat. No. 4,307,168 derives from the fact that the present toner particles do not contain a catalyst, but rather a reactant that is consumable. In the catalyst based systems of U.S. Pat. No. 4,307,168 only a small fraction of the toner is available to stimulate the dye-producing reaction. On the other hand, in the present system the entire active load of the toner particle is consumed. Hence, even though the amplification gain per trigger molecule is less than in the U.S. Pat. No. 4,307,168 examples, this is counterbalanced by the much greater amount of active (i.e. consumable) species so that the final sensitivity is very high.

DETAILED DESCRIPTION

Figure 1:
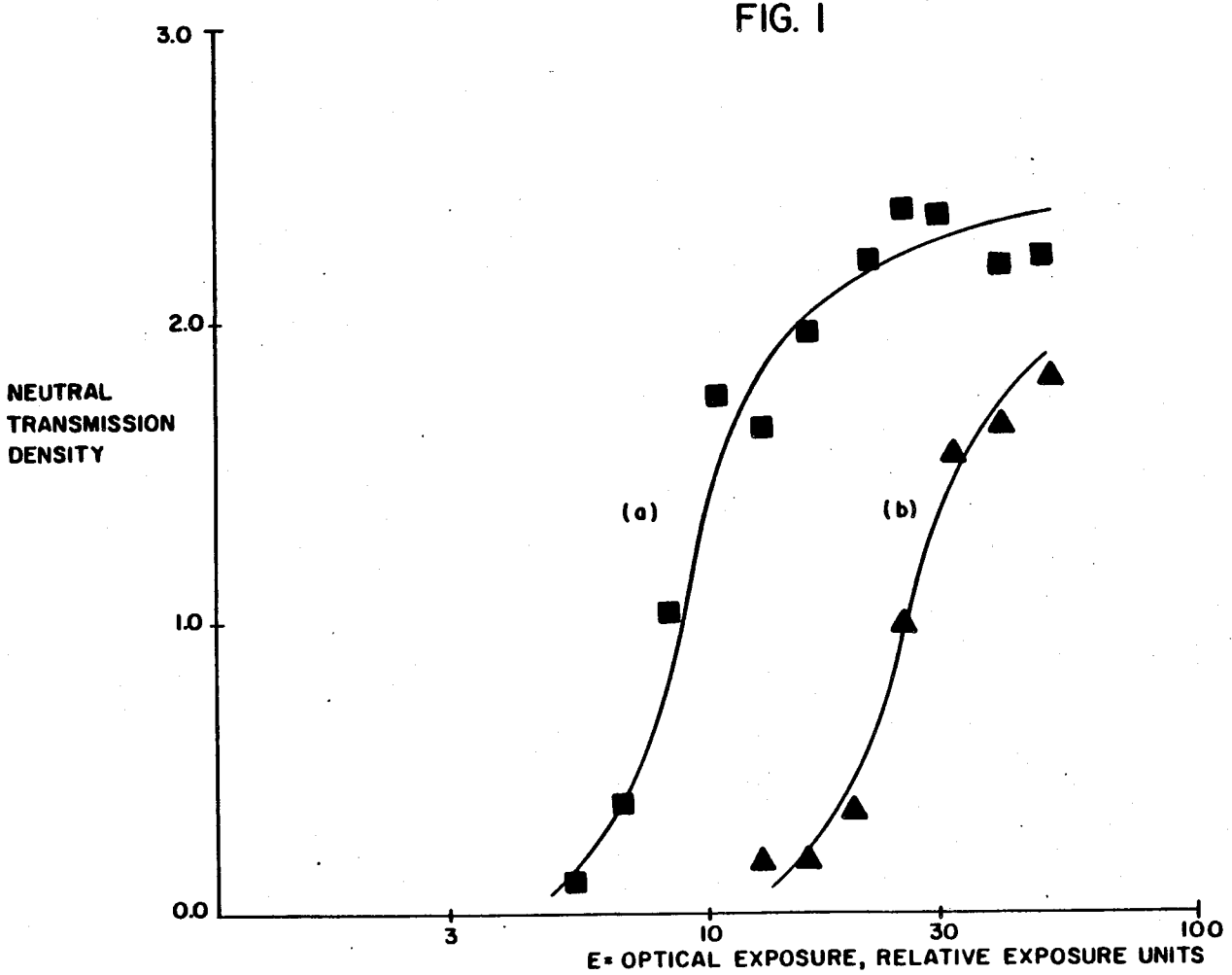

In accordance with the present invention, an image-forming process is disclosed in which an amine, such as ammonia, is released imagewise to produce amplification of electrographic toned images.

While the inventors do not wish to be bound by any particular theory by which the present invention operates, it is hypothesized that the operating mechanism is based on amplifier-cobalt(III) complex chemistry.

Amplifier-cobalt(III) complex chemistry is presently understood as shown in Scheme 1. For simplicity some equations are left unbalanced. Equation (1) shows generalized reduction of cobalt(III) hexammine trifluoroacetate ("Cohex") (1) by suitable reducing agent [R] to yield free $NH_3$, where the equilibrium $K_1$ is shifted extremely in the direction of free ammonia. $NH_3$ reacts with the amplifier o-phthalaldehyde (2) to yield the adduct dihydroxyisoindoline (3). The intermediate (3) can act as [R] in Eq. (1), and it can also dehydrate to produce another intermediate, the hydroxyisoindole (4). Rearrangement of (4) can produce the colorless phthalimidine (5) or (4) can dehydrate and polymerize into an oligomeric mixture of dyes (6). Small polymers, with n between 2 and 6, are produced.

Two factors are important for efficient dye production. The first factor is the branch point at (3) which leads to autocatalytic production of $NH_3$, resulting in amplification gain. The second factor is the branch point at (4). The rearrangement of (4) to (5) has first order kinetics, whilst the production of a polymeric dye molecule with n repeating units is effectively $n^{th}$ order in (4).

Scheme I

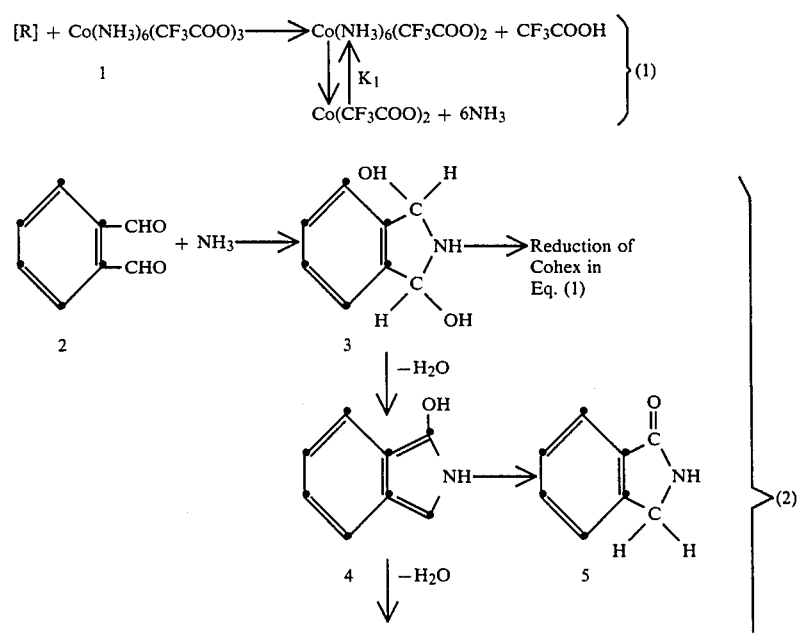

-continued

Scheme 1

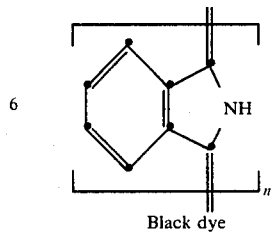

Hence, the ratio of the rates to form (6) and (5) is effectively proportional to the (n−1) power of the concentration of (4). If $NH_3$ concentration is below a threshold value, (5) is produced preferentially, and no dye is formed. High $NH_3$ concentration and consequently high concentration of 4 produces black dye preferentially. This threshold effect is vital in suppressing second-stage dye production in background (fog) areas of the first-stage electrographic toner deposit.

The overall amplification factor is modest for amplifier-cobalt(III) complex chemistry, about 60 dye monomer units per released $NH_3$ molecule. Nevertheless, toners are loaded with a high concentration of activator, and the fact that virtually all of this activator is available for consumption in the amplification chemistry means that the overall gain can be as high or higher than that of heterogeneous catalytic systems.

Toners useful in the present invention can be divided into two classes, those which produce $NH_3$ by direct decomposition of the toner (Class 1) and those which produce $NH_3$ as a result of chemical reactions triggered by toner molecules entering the amplifier-cobalt(III) complex image-receiving element receiver sheet during hot roller processing (Class 2).

Class 1 toners are generally weakly active. They rely on diffusion of released $NH_3$ to the receiver, and therefore work best with unovercoated amplifier-cobalt(III) complex receives. Class 1 toners are sources of homogeneous catalyst in the sense that autocatalytic molecules ($NH_3$) are introduced into the receiver imagewise. Ammonium salts, ammonium complexes and ammonia-containing polymers are examples of activators used in Class 1 toners.

Class 2 toners, on the other hand, can be extremely active but do not themselves contain a catalyst for the amplification chemistry. In this respect, amplifier-cobalt(III) complex electrography using Class 2 toners differs from previous systems utilizing truly catalytic toners. One can think of Class 2 toner molecules as chemical trigger molecules for releasing the $NH_3$ catalyst imagewise in the receiver sheet.

Different subclasses of Class 2 toners have been identified. Class 2A toners contain direct reductants of Cohex (1), liberating $NH_3$ via Eq. (1). Class 2B toners contain molecules that can form adducts with the amplifier, e.g. o-phthalaldehyde (2), and these adducts then reduce Cohex (1). Class 2C toners contain chelators or active ligands capable of replacing $NH_3$ in the cobalt(III) coordination shell. Class 2D toners utilize super cohex type chemistry, discussed in the next paragraph. Generally 2D toners contain a compound containing a conjugated pi bonding system capable of forming a chelate with cobalt(II) ions which is oxidizable to the corresponding cobalt(III) chelate. An example of an active ingredient used in Class 2D toner is pyridylazoresorcinol. The relevant "super cohex" chemistry is shown in Scheme 2.

Scheme 2
Super Cohex Chemistry

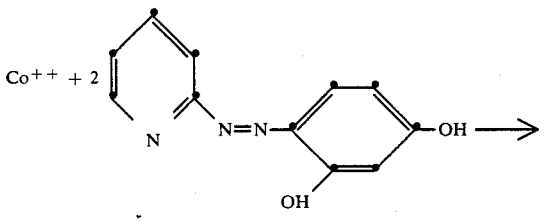

(7) = PAR $$Co(PAR)_2^{++} \quad (3)$$

$$Co(PAR)_2^{++} + Co(NH_3)_6(CF_3COO)_3 \longrightarrow$$

(1)

$$Co(PAR)_2^{+++} + Co^{++}$$

$$6NH_3 + 3(CF_3COO)^-$$

(8) (4)

Pyridylazoresorcinol (7) chelates adventitious cobalt(II) species, normally present in small concentration in the amplifier-cobalt(III) complex image-receiving element via the equilibrium $K_1$ of Scheme 1. Alternatively, a small amount of reducing agent can be incorporated into the toner along with pyridylazoresorcinol. This would insure that cobalt(II) would be present (from the reduction of cobalt(III)) and eliminate the need to rely on adventitious cobalt(II). The resulting $Co(PAR)_2^{++}$ complex is a powerful electron donor and reduces Cohex (1) thereby liberating free $NH_3$. Note that regenerated cobalt(II), a true catalyst, is not introduced into the chemistry via the toner as is the case in Example 12 of U.S. Pat. No. 4,307,168. Also note that, unlike U.S. Pat. Nos. 4,171,221 and 4,307,168, the image-receiving elements of the present invention do not contain activator and therefore their shelf-life is much improved.

When Class 2D toner is employed with amplifier-cobalt(III) complex receivers there is interactive coupling of both amplifier-cobalt(III) complex and "super cohex" cyclic chemistries, leading to positive feedback of each chemistry. Cobalt(II) ions, produced as a by-product in Scheme 1, can enter Scheme 2 to enhance the rate. Similarly, $NH_3$ produced as a by-product in Scheme 2, can enter Scheme 1 to enhance the rate. This is illustrated by Scheme 3.

Scheme 3

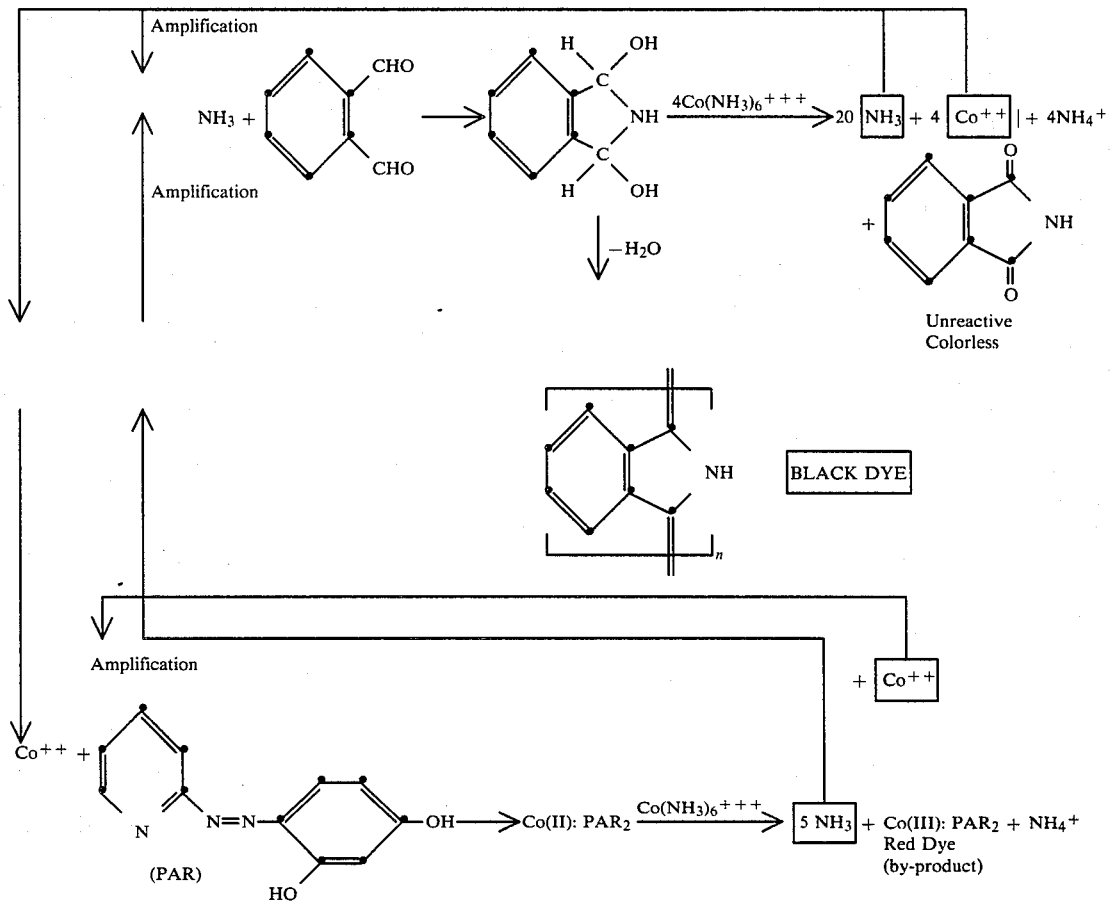

COBALT(III) COMPLEXES

The cobalt(III) complexes employed in the practice of this invention are those which are capable of releasing an amine when processed. Suitable cobalt(III) complexes include those listed in Table I of U.S. Pat. No. 4,171,221 issued to DoMinh on Oct. 16, 1979, which is hereby incorporated by reference in its entirety. Exemplary cobalt(III) complexes are set forth in Table I.

TABLE I

Exemplary Cobalt(III) Complexes

C-1 hexa-ammine cobalt(III) benzilate
C-2 hexa-ammine cobalt(III) thiocyanate
C-3 hexa-ammine cobalt(III) trifluoroacetate

AMPLIFIERS

Amplifiers useful in the practice of the present invention include compounds which, on reaction with an amine (i) form a dye or dye precursor, or (ii) reduce the cobalt(III) complex, resulting in the release of additional amine. Generally the amplifier is an aromatic dialdehyde, and typically it is o-phthalaldehyde. Additional amplifiers include blocked leuco dyes, thioamides, quinones, etc. as described in U.S. Pat. Nos. 4,124,392 and 4,188,217 and in Research Disclosure No. 15874, June 1977, page 74.

ACTIVATORS

Compounds which, under the processing conditions release an amine either directly or indirectly can be used as activators in toners in the practice of this invention. Exemplary activators are set forth in Table II.

TABLE II

Exemplary Preferred Activators

A-1: Reinecke salt
A-2: hydroquinone
A-3: 4-hydroxymethyl-4-methyl-1-phenyl-3-pyrazolidinone
A-4: styrene/ammonium acrylate copolymer
A-5: 1-phenyl-3-pyrazolidinone
A-6: ascorbic acid
A-7: ammonium benzoate
A-8: ammonium hydrogen phosphate
A-9: ammonium carbonate
A-10: ammonium sulfate
A-11: pyridylazoresorcinol
A-12: pyrogallol
A-13: gallic acid
A-14: methyl gallate
A-15: phenazine methosulfate
A-16: 1,5-diphenyl-3-thiocarbohydrazide
A-17: pyridylazoresorcinol disodium salt
A-18: nitrosoresorcinol sodium salt
A-19: pyrocatechol violet A-20: ammonium molybdate
A-21: 4,4-bis(hydroxymethyl)-1-phenyl-3-pyrazolidinone
A-22: hydantoin
A-23: aurintricarboxylic acid, ammonium salt
A-24: dibasic ammonium phosphate
A-25: quercetin
A-26: EDTA disodium salt
A-27: pyridylazonaphthol
A-28: thiourea
A-29: 4-hydroxy-butyric acid-2-phenylhydrazide
A-30: Congo Red
A-31: succinamide
A-32: succinimide
A-33: 2-imidazolidinone
A-34: dithiooxamide
A-35: indole-3-carboxaldehyde
A-36: phthalimide
A-37: ammonium sulfamate
A-38: 2-benzoyl-1,1,1-trimethyl-hydrazinium hydroxide (inner salt)
A-39: 1-nitroso-2-naphthol
A-40: ammonium purpurate
A-41: tris(triphenylphosphine)chlororhodium
A-42: tri-o-tolylphosphine
A-43: thiocarbanilide
A-44: indole
A-45: 1,3-diphenylguanidine
A-46: ethylene thiourea
A-47: 2-pyridine aldoxime
A-48: phenylformyl hydrazine
A-49: 2-pyridinecarboxaldehyde-2-pyridylhydrazone
A-50: DL-tryptophan
A-51: o-sulfobenzoic acid, monoammonium salt
A-52: trimethylaminebenzimide
A-53: dithizone Also useful as activators are the chelate-forming compounds described in U.S. Pat. No. 4,171,221.

The activators may be used alone or in combinations of two or more activators. The activators can be used in the toners of either dry or liquid developers. Any activator that satisfies the requirements of low reactivity and insolubility can probably be made into a useful liquid developer. This can be done in most cases simply by substituting activator for the pigment in standard liquid developer formulations. As long as there is little or no chemical interaction between toner material and the binder and charging polymers, developers resembling standard dispersions can be made without difficulty.

Dry toners can be made with similar ease, i.e., by straightforward modification of standard techniques. Activators for inclusion in dry toners should have grindability and insensitivity to relative humidity. Low melting point or high vapor pressure at the temperature of second-stage processing is desirable to promote efficient reaction with amplifier-cobalt(III) complex receivers. In addition, a dry toner must have appropriate tribocharging characteristics against a suitable carrier. Lack of reactivity with binders and charge agents during compounding is also necessary. The determination of whether a particular activator is suitable for use in a dry or liquid developer can be determined through normal experimentation by one skilled in the art.

An important feature of first-stage toner technology is that many of the requirements of conventional toners need not concern the toner formulator, e.g. image toughness and toner fusibility may be of secondary importance. Image toughness must of course be present after the second-stage processing, and amplifier-cobalt(III) complex images are both tough and archival. It is worth pointing out that if first stage images are indeed tough, then they can be stored for long periods and developed by second-staging, either at some later time or at some different physical location.

Any electrostatic charge pattern on a dielectric material formed, e.g., by electrical deposition of charge on a dielectric material or by electromagnetic exposure of a charge photoconductive material may be amplified according to the techniques and materials of this invention. It is anticipated that any organic or inorganic photoconductor element can be used.

In one embodiment of the process of the present invention, the element to which toner is applied is separate from an image-receiving element. After toner is applied to the first element, it is placed in contact with the image-receiving element and heated. A convenient method of heating comprises passing the elements between heated rollers.

It is further anticipated that the advantages of this process will work equally well with a photoconductor layer and an amplifier-cobalt(III) complex-containing layer occurring in a single multilayer element. This single, integral film package might contain the following arrangement of layers, e.g., a film support, a photoconductive layer, an amplifier-cobalt(III) complex layer and a thermoplastic overcoat layer. Chemical activator from the toner deposited on the surface of the overcoat layer could be made to migrate through the thermoplastic layer to the amplifier-cobalt(III) complex layer by suitable thermal processing. The activator would then provide ammonia release with subsequent amplification in the amplifier-cobalt(III) complex layer. Alternatively, the integral film package may comprise a film support, an amplifier-cobalt(III) complex layer and a photoconductive layer. In this arrangement the overcoat layer would not be needed.

However, in this or any other envisioned film package it is expected that some appropriate method for containment of the imagewise released amine and for prevention of random diffusion of amplifier would be required. These methods include face down thermal processing on a substrate impermeable to amine, or the use of cover sheets, e.g., Estar$^R$ placed over the film during thermal processing through heated rollers or perhaps, the use of specialized heated rollers in which a compliant roller covering would function as a cover sheet during processing. Binders and overcoats which can be used in amplifier-cobalt(III) complex elements include those described in U.S. Pat. Nos. 4,107,155; 4,247,625; 4,288,531; and in *Research Disclosure* No. 18436, August 1979, p. 446.

To avoid processing temperatures which might adversely affect the dimensional stability of the film support or supports, a synergistic combination of thermal destabilizers may be used to lower the range of processing temperatures as described in U.S. Pat. No. 4,294,912 and in Research Disclosure No. 20020, December 1980, p. 549.

The amplification processes of this invention may also be used to extend the spectral range of a film into the ultraviolet or infrared regions. A latent electrostatic image formed by imagewise exposure to ultraviolet or infrared radiation, to which a charged photoconductive film may have minimal sensitivity, could be developed to provide a low density toned image which could then be significantly enhanced by this process. Extension of spectral response to x-ray wavelengths should be possible, and x-ray sensitive photoconductors can also be used.

Furthermore, any low density electrographic image could be enhanced by this process. A low Dmax image formed, for example, by a migration imaging process such as photoelectrophoresis, could be significantly enhanced by amplifier-cobalt(III) complex amplification by incorporating a suitable activator with the photosensitive pigment.

The amplification process and toners will be evidenced by the following examples, which are designed to be illustrative rather than to offer undue limitations in the scope of the invention. The words Isopar, Kodak, Ektavolt, Solvesso, Gaulin, MacBeth, Quantalog and Piccolastic are Trademarks.

Table III summarizes the results of Examples 1–13.

EXAMPLE 1

Amplifier-cobalt(III) complex receiver with Reinecke salt toner

For use in the first stage of development, an electrographic liquid developer was prepared by dissolving Reinecke salt ($NH_4[Cr(NH_3)_2(SCN)_4].H_2O$) in a tetrahydrofuran (THF) solution containing a polymeric stabilizer and precipitating this mixture into Isopar G according to the following formulation:

Reinecke salt: 3.0 grams of 10% solution in THF
poly(t-butylstyrene-co-lithium methacrylate)stabilizer: 6.0 grams of 10% solution in THF
Isopar G (an isoparaffinic aliphatic hydrocarbon liquid available from Exxon Corp.): 470 milliliters The resultant negative polarity toner dispersion was tested on Kodak Ektavolt Recording Film Type SO-101, corona charged to positive or negative 500 volts and exposed to a standard alpha-numeric, negative test target. The latent electrostatic image was developed by dipping the film in the above developer and the toned image was permitted to air dry to remove the liquid carrier.

To amplify the toner image the toned film from above was sandwiched, coated sides in contact, with an amplifier-cobalt(III) complex receiver sheet of the following composition, coated and dried on subbed poly(ethylene terephthalate) film support to a 5 micrometer thickness:

| (grams/m$^2$) | Coverage |
|---|---|
| poly(ethylene-co-1,4-cyclohexylene dimethylene-1-methyl-2,4-benzenedisulfamide) | 7.5 |
| phthalaldehyde | 2.5 |
| Hexammine Cobalt(III) trifluoroacetate (Cohex TFA) | 1.2 |
| SF-1066 (a silicone surfactant available from General Electric) | 0.4 |

The toned film and receiver sandwich from above, with the receiver on top, was passed one or more times through a heated roller device at various roll speeds and temperatures ranging from 121° C. to 168° C. with roller pressure held constant at 4.3 kg per lineal centimeter.

Observations

High density and high contrast images (both positive and negative) were formed in the receiver. For comparison, an untoned SO-101 film did not produce any visible density in a similar amplifier-cobalt(III) complex receiver when processed in the heated roller device.

EXAMPLE 2

Overcoated amplifier-cobalt(III) complex receiver with hydroquinone toner

An electrographic liquid developer, in which the toner contained hydroquinone in place of Reinecke salt, was prepared according to the formulation as described in Example 1.

The resultant negative polarity toner dispersion was used for first stage development as described in Example 1.

The toned film was then sandwiched and heated with an amplifier-cobalt(III) complex receiver as described in Example 1 with the exception that the receiver was previously overcoated with a 2 micrometer layer of Cohex TFA (coverage 1.1 grams/m$^2$) dissolved in a binder copolymer of acrylamide-N-vinyl-2-pyrrolidone-2-acetoacetoxyethyl methacrylate (50/45/5 by weight) (2.2 grams/m$^2$). The heated roller device was run at various roll speeds at a roll pressure of 2.1 kg per lineal centimeter and roll temperatures from 121° C. to 143° C. After one or more passes through the device the sandwich was delaminated and the toned image was sandwiched with a second sheet of overcoated amplifier-cobalt(III) complex receiver and processed through the roller device.

Observations

The results were improved over those obtained in Example 1. The ability to produce duplicate images was also demonstrated by separating the toned photoconductor from the receiver and using it to produce another image with an unused receiver sheet. Based on this characteristic ability, it is anticipated that a relatively low voltage, first stage toned image would be useful to activate or trigger the formation of density in the second stage.

EXAMPLE 3

Overcoated amplifier-cobalt(III) complex receiver with 4-hydroxymethyl-4-methyl-1-phenyl-3-pyrazolidinone tone An electrographic liquid developer, containing 4-hydroxymethyl-4-methyl-1-phenyl-3-pyrazolidinone, in place of Reinecke salt, was prepared as described in Example 1.

The resultant positive polarity toner dispersion was used for first stage development as described in Example 1.

The toned film was sandwiched 15 times with separate, overcoated amplifier-cobalt(III) complex receiver sheets as described in Example 2.

Observations

The results were approximately similar to those obtained in Example 2. The ability to produce multiple copies was demonstrated.

EXAMPLE 4

Low voltage test with modified 4-hydroxymethyl-4-methyl-1-phenyl-3-pyrazolidinone toner An electrographic liquid developer was prepared by combining a mill grind formulation containing an activator into a premix formulation containing a binder and a charge control polymer. The mill grind formulation contained the following materials:

4-hydroxymethyl-4-methyl-1-phenyl-3-pyrazolidione: 3 grams poly(t-butylstyrene-co-lithium methacrylate) stabilizer: 3 grams Solvesso 100 (available from Exxon): 44 grams which were ground for 2 weeks in a roll mill.

The premix formulation contained the following components:

Ground premix from above: 7 grams

Poly[2,2,-dimethyl-1,3-propylene-4-methyl-4-cyclohexene-1,2-dicarboxylate-co-terephthalate-co-5-(N-potassio-p-toluene-sulfonamidosulfonyl)isophthalate (50/45/5)] binder: 5.04 grams 10% solution in Solvesso vinyl toluene-co-lauryl methacrylate-co-N-methacryloyl oxyethyl-N,N,N-trimethylammonium p-toluenesulfonate charge control agent: 0.735 grams 10% solution in Solvesso This developer premix formulation was homogenized in Isopar G in a Gaulin homogenizer at 280 kg/cm$^2$ for 5 minutes. A 1200 ml batch of working developer was prepared containing a final concentration of 0.35 grams of 4-hydroxymethyl-4-methyl-phenyl-3-pyrazolidinone activator per liter of developer.

A. Separate samples of an Estar$^R$ (polyethylene terephthalate) film with a bare CuI electrode layer were bias-developed to 320, 160, 80, 40, 20, and 10 volts respectively, using the above positive polarity working developer. Each toned film sample was processed as described in Example 2 by sandwiching once with separate, overcoated amplifier-cobalt(III) complex receiver sheets.

B. In separate tests, Kodak Ektavolt Recording Film Type SO 101 charged to 40 volts was exposed to a step tablet containing 14 steps of 0.15 log E units per step and to an alphanumeric pattern. The film was electrographically toned as described in Example 1 and then thermally processed by sandwiching once with the overcoated amplifier-cobalt(III) complex receiver, as described in Example 2.

Observations

A. Based on visual observation of the receiver sheets, the results showed maximum density for all of the toner laydown levels. Furthermore, it was concluded that the system showed high sensitivity with Dmax obtained from only 10 volts worth of toner.

B. The step tablet test suggested a measurable increase in threshold sensitivity by comparison with a similar experiment in which unovercoated receiver was used. The least exposed step had approximately $10^{-2}$ of the light exposure of the most exposed step. It was estimated that the film sample initially charged to 40 volts had a most exposed step equivalent voltage of approximately 4 volts or less. The toner coverage was very small and estimated by reflection viewing as less than 10% of the toner coverage on the least exposed step. These results demonstrate that a threshold toner coverage, i.e., a toner laydown capable of producing a useful density in the receiver, can be produced by a voltage differential ($\Delta V$) of less than 4 volts.

EXAMPLS 5–8

Amplifier-cobalt(III) complex receiver with pyridylazoresorcinol and other toners Electrographic liquid developers were prepared as described in Example 4 with the exception that they contained the following activator materials:

Example 5: pyridylazoresorcinol

Example 6: pyrogallol

Example 7: gallic acid

Example 8: methyl gallate

Four SO-101 films were initially charged to 40 volts and developed with each liquid developer described above (Ex. 5–8) according to the procedure given in Example 1.

The toned films were sandwiched with unovercoated amplifier-cobalt(III) complex receiver elements and processed in a heated roller device as described in Example 1 except that the roll pressure was 3.2 kg per lineal centimeter.

Observations

The results were similar to those obtained in Example 4 with equal (Examples 6, 7) or better (Example 5, 8) developer stability.

EXAMPLES 9 AND 10

Low voltage images-amplifier-cobalt(III) complex receiver with pyridylazoresorcinol and methyl gallate toners These examples were similar to Examples 5 and 8 with the exception that they were charged to an initial voltage of 3.3 volts and 9.5 volts, respectively.

Observations

The results were similar to those obtained in Examples 5 and 8. The test image from Example 10 showed heavy background and a mean neutral density of 2.80 gased on measurements using a MacBeth Quantalog densitometer. This demonstrates that a high density can be produced by very small toner coverages, i.e. a few percent of the coverage necessary with conventional liquid development using a conventional carbon toner.

EXAMPLE 11

Microimaging-Amplifier-cobalt(III) complex receiver with pyridylazoresorcinol toner This example was similar to Example 5 except that the test target was reduced 94 times and the initial film voltage was 300 volts. Second stage development on the heated roller device was conducted at 149° C. and at a roll pressure of 2.1 kg per lineal centimeter.

Observations

The results were similar to those obtained in Example 5. A resolution of 144 lines/mm was observed.

TABLE III

| Examples | Liquid Toner Composition | Polarity | Sensitivity | Image Sharpness | Developer Stability |
|---|---|---|---|---|---|
| 1 | Reinecke salt | (−) | low | poor | poor |
| 2 | Hydroquinone | (−) | medium | fair | poor |
| 3 | 4-hydroxymethyl-4-methyl-1-phenyl-3-pyrazolidinone | (+) | medium | poor | poor |
| 4 | 4-hydroxymethyl-4-methyl-1-phenyl-3-pyrazolidinone | (+) | high | good | fair |
| 5, 9, 11 | Pyridylazoresorcinol | (+) | high | good | excellent |
| 6 | Pyrogallol | (+) | high | good | fair |
| 7 | Gallic Acid | (+) | high | good | fair |
| 8, 10 | Methyl Gallate | (+) | high | good | good |

EXAMPLE 12

Dry 4-hydroxymethyl-4-methyl-1-phenyl-3-pyrazolidinone toners with amplifier-cobalt(III) complex receiver A series (A-E) of dry toners containing 4-hydroxymethyl-4-methyl-1-phenyl-3-pyrazolidinone were prepared according to the following formulations:

| | A | B | C | D | E |
|---|---|---|---|---|---|
| | parts by wt | | | | |
| Piccolastic D-150 resin (a polystyrene available from Pennsylvania Industrial Chemicals) | 28.5 | 27 | 25.5 | 24 | 26.7 |
| 4-hydroxymethyl-4-methyl-1-phenyl-3-pyrazolidinone | 1.5 | 3 | 4.5 | 6 | 3.0 |
| Ammonyx 4002 (cationic surfactant available from Onyx Chemical) | — | — | — | — | 0.3 |

The toners were tested for their ability to form density in an amplifier-cobalt(III) complex receiver. The toners were dusted onto transparent sticky tape, sandwiched with an amplifier-cobalt(III) complex receiver similar to that described in Example 1 and processed as described in Example 11 except that the roll pressure was 3.2 kg per lineal centimeter. As a control, a toner without 4-hydroxymethyl-4-methyl-1-phenyl-3-pyrazolidinone (Piccolastic D-150 only) was tested.

Observations

The results indicated that density was formed at five (5) different levels of 4-hydroxymethyl-4-methyl-1-phenyl-3-pyrazolidinone, whereas, no color (density) was observed for the control toner in which there was no 4-hydroxymethyl-4-methyl-1-phenyl-3-pyrazolidinone.

EXAMPLE 13

Dry 4-hydroxymethyl-4-methyl-1-phenyl-3-pyrazolidinone toner with amplifier-cobalt(III) complex receiver Dry toner, indicated as composition E in Example 12, was added at 10 weight % to 90 weight % ferrite carrier to form a dry electrographic developer. This developer mixture was used in a magnetic brush development device to develop an electrostatic latent image having $\Delta V = 400$ volts on SO-101 film in a positive/positive mode to form a first-stage, dense, sharp, alpha-numeric image which was subsequently oven-fused at 140° C., prior to second-stage processing.

The toned, fused film was sandwiched with an amplifier-cobalt(III) complex receiver as described in Example 1 and thermally processed as described in previous examples at a roll pressure of 2.1 kg per lineal centimeter, a roll temperature of 143° C. and a process speed of 1 cm/sec.

On another film sample a density patch was developed at 20 volts brush bias and this toned film was thermally processed as described above with the exception that the roll pressure was 4.3 kg per lineal centimeter and the roll temperature was 149° C.

Observations

The densities were similar to those described in previous examples for liquid developers. The density patch had a measured Dmax of 2.5 neutral density.

EXAMPLE 14

Amplifier-cobalt(III) complex receiver with pyridylazoresorcinol toner on Kodak Ektavolt Recording Film Type SO-102 and high speed aggregate photoconductor and comparison with photoactivated materials This example employed a pyridylazoresorcinol toner as described in Example 5 in a liquid development device with a biased development electrode. Kodak Ektavolt Recording Film Type SO-102 and high speed aggregate photoconductor (HSPC) of the type disclosed in U.S. Pat. Nos. 3,873,311 and 3,873,312 film were used in place of Kodak Ektavolt Recording Film Type SO-101. Unovercoated and overcoated amplifier-cobaltZ(III) complex receivers similar to the types described in Examples 1 and 2, respectively, were also tested. Exposures were made using either a 15 patch test target or a solid white reflection target. The minimum exposure was measured for the maximum density at 645 nanometers.

The second stage of development was accomplished in a single pass on a heated roller device as described in Example 1 at a roll speed of 1 cm/sec., a temperature of 149° C. and a roll pressure of 4.3 kg per lineal centimeter.

For comparison, a similarly overcoated phthalaldehyde-cobalt(III) complex-quinone (PACQ) receiver containing the photoreductant 2-isopropoxy-3-chloro-1,4-naphthoquinone at a coverage of 0.037 g/m$^2$ was exposed as above and processed by heating for 5 seconds at 125° C. The comparison element is of the same type as disclosed in U.S. Pat. No. 4,201,588.

The threshold photographic sensitivity was estimated in relative exposure units/cm$^2$ and the results are tabulated below.

| Photoconductor | Receiver | Dmax | Threshold Photographic Sensitivity relative exposure units/cm$^2$ 15 patch target | White reflection target |
|---|---|---|---|---|
| HSPC film | unovercoated | 2.6 | $2 \times 10^{-2}$ | $8 \times 10^{-2}$ |
| HSPC film | overcoated | 3.7 | $2 \times 10^{-2}$ | $8 \times 10^{-2}$ |
| SO-102 film | unovercoated | 2.6 | $2 \times 10^{-1}$ | $6 \times 10^{-1}$ |
| SO-102 film | overcoated | 3.2 | $7 \times 10^{-1}$ | $6 \times 10^{-1}$ |
| Photosensitive material (prior art) | overcoated PACQ | 3.0 | (at 350–430 nm) | $2 \times 10^{5}$ |

Observations

The results show that the process of the present invention achieves a photosensitivity some 6 orders of magnitude better than the photosensitive material of the prior art.

Sensitivities which are less than $2\times10^{-2}$ represent values that are less than the accuracy of the measuring equipment.

EXAMPLE 15

Overcoated amplifier-cobalt(III) complex receiver with cobalt(II) additive

The purpose of this example is to show that the addition of a cobalt(II) compound to an overcoat coated on an amplifier-cobalt(III) complex receiver can result in an increase in photographic speed.

An amplifier-cobalt(III) complex receiver was prepared similar to the receiver described in Example 1 and overcoated and dried to a 2 micrometer thickness with the following formulation at the coverages indicated:

| | Coverage: mg/m$^2$ |
|---|---|
| Binder used in Example 2 | 2150 |
| Cohex TFA | 538 |
| $CoCl_2$* | 1.1 |

*The $CoCl_2$ additive was dissolved in the binder in the above formulation.

A positive-polarity, liquid pyridylazoresorcinol toner was prepared as described in Example 5.

A green-sensitive, homogeneous organic photoconductor film, containing 0.08% sensitizing dye and herein referred to as Film A, was charged to +383 volts and contact exposed to white light through a 1.61 neutral density filter and through a step tablet (18 steps of 0.1 ND/step) to an approximate ΔV of 22.2 volts.

The positive-polarity pyridylazoresorcinol toner from above was used for first stage development of the latent electrostatic test pattern formed on the photoconductor film.

In the second stage of development the toned film from above was sandwiched, coated side in contact, with an amplifier-cobalt(III) complex receiver as described above and the sandwich was passed once through a heated roller device at a roll speed of 1 cm/sec., a temperature of 154° C. and a roller pressure of 4.3 kg per lineal centimeter.

For comparison, a second amplifier-cobalt(III) complex receiver without $CoCl_2$ additive was processed.

The neutral transmission densities of the steps formed on each receiver were measured and plotted against the exposures as illustrated in FIG. I for the receiver with $CoCl_2$ additive (curve A) and for the receiver without $CoCl_3$ (curve B).

Observations

Referring to FIG. I, at a speed point of 0.2 above fog density (0.2) the E units are reduced by about ⅓ (from 18.8 to 6.8) for the receiver containing the $CoCl_2$ additive. This decrease in exposure is approximately equivalent to a 0.44 log E speed increase.

EXAMPLE 16

Low dye photoconductor vs photographic speed

The purpose of this example is to show that the level of sensitizing dye in a photoconductor film and, hence, the coloration of that film, can be significantly reduced and yet maintain a high phthalaldehyde-cobalt(III) complex (PAC) process speed, as compared to conventional liquid development with full strength sensitizer in the film.

This example was similar to Example 15 with the following exception: An additional green-sensitive, organic photoconductor film, containing 0.8% sensitizing dye and herein referred to as Film C was prepared and imaged as described in Example 15. Film D was similarly prepared based on film A containing 0.08% of the same sensitizing dye.

The green transmission densities of both Films D and C were measured on a MacBeth densitometer and the film base density was subtracted to yield a net value which is recorded in Table IV below.

The equivalent process speed can be compared from sensitometry at 500 nm and at a Dmax of 1.4 with a ΔV of 3.4 volts (estimated value from curve (a) of FIG. I) for Film D and a "conventional" ΔV of 400 volts (600 volts reduced to 200 volts) for Film C (comparison). A "conventional" liquid development of 400 volts will produce a density of approximately 1.4 using a carbon developer having a suitable density per charge ratio.

TABLE IV

| Film | % Dye | Net Green Transmission Dens. | Δ V Volts | Equivalent Process Speed Relative Exposure Units/cm$^2$ @ 500 nm |
|---|---|---|---|---|
| D | 0.08 | 0.03 | 3.4 | 10 |
| C (comparison) | 0.8 | 0.21 | 400 | 199 |

Observations

The results show that Film D has a process speed some 20 times that of Film C (in relative exposure units/cm$^2$). A large part of this speed increase is associated with the high gamma (typically, gamma greater than 5) of the PAC process as compared with conventional liquid developments (gamma equals approximately 1).

The invention has been described in detail with particular reference to preferred embodiments thereof, but it will be understood that variations and modifications can be effected within the spirit and scope of the invention.

We claim:

1. A method of forming an image which comprises applying electrographic toner particles to a charge pattern on a support followed by a chemical amplification processing step comprising heating the toner image in the presence of an image-receiving element comprising:

(a) a cobalt(III) complex capable of releasing an amine on processing, and (b) an amplifier which, on reaction with an amine:

(i) forms a dye or dye precursor, or (ii) reduces the cobalt(III) complex, resulting in the release of additional amine, said toner comprising an activator which, under the conditions of processing releases an amine either directly or indirectly.

2. A method as claimed in claim 1 in which the cobalt(III) complex (a) contains at least two amine or amine ligands.

3. A method as claimed in claim 1 in which the cobalt(III) complex (a) contains 3–6 ammine ligands.

4. A method as claimed in claim 1 in which the cobalt(III) complex (a) is hexa-ammine cobalt(III) benzilate, hexa-ammine cobalt(III) thiocyanate or hexa-ammine cobalt(III) trifluoroacetate

5. A method as claimed in claim 1 in which the amplifier (b) is an aromatic dialdehyde.

6. A method as claimed in claim 1 in which the amplifier (b) is o-phthalaldehyde.

7. A method as claimed in claim 1 in which the amplifier (b) is blocked leuco dye, thioamide or quinone.

8. A method as claimed in claim 1 in which the activator is ammonium salt, ammonium complex or ammonia-containing polymer.

9. A method as claimed in claim 1 in which the activator is capable of reducing a cobalt(III) ammine to cobalt(II) and amine.

10. A method as claimed in claim 1 in which the activator is capable of forming an adduct with the amplifier, said adduct reduces cobalt(III) ammine to cobalt(II) and amine.

11. A method as claimed in claim 1 in which the activator is a chelator or an active ligand which is capable of replacing an ammine ligand in a cobalt(III) ammine, resulting in the release of amine.

12. A method as claimed in claim 1 in which the activator is a compound containing a conjugated pi bonding system capable of forming a chelate with cobalt(II) ions which is oxidizable to the corresponding cobalt(III) chelate.

13. A method as claimed in claim 1 in which the activator is a nitrosoarol, dithiooxamide, formazan, hydrazone, Schiff base or aromatic azo compound.

14. A method as claimed in claim 1 in which the activator is selected from Reinecke salt, hydroquinone, 4-hydroxymethyl-4-methyl-1-phenyl-3-pyrazolidinone, 1-phenyl-3-pyrazolidinone, styrene/ammonium acrylate copolymer, ascorbic acid, ammonium benzoate, ammonium hydrogen phosphate, ammonium carbonate, ammonium sulfate, pyridylazoresorcinol, pyrogallol, gallic acid, methyl gallate, phenazine methosulphate, 1-5-diphenyl-3-thiocarbohydrazide, pyridylazoresorcinol disodium salt, nitrosoresorcinol sodium salt, pyrocatechol violet, ammonium molybdate, 4,4-bis(hydroxymethyl)-1-phenyl-3-pyrazolidone, hydantoin, aurintricarboxylic acid ammonium salt, dibasic ammonium phosphate, quercetin, EDTA disodium salt, pyridylazonaphthol, thiourea, 4-hydroxy-butyric acid-2-phenylhydrazide, Congo Red, succinamide, succinimide, 2-imidazolidinone, dithiooxamide, indole-3-carboxaldehyde, phthalimide, ammonium sulfamate, 2-benzoyl-1,1,1-trimethyl-hydrazinium hydroxide (inner salt), 1-nitroso-2-naphthol, ammonium purpurate, tris(triphenylphosphine)chlororhodium, tri-o-tolylphosphine, thiocarbanilide, indole, 1,3-diphenylguanidine, ethylene thiourea, 2-pyridine aldoxime, phenylformyl hydrazine, 2-pyridinecarboxaldehyde-2-pyridylhydrazone, DL-tryptophan, -sulfobenzoic acid monoammonium salt, trimethylaminebenzimide, dithizone or combinations thereof.

15. A method as claimed in claim 1 in which the image-receiving element is placed in contact with the toner image prior to processing.

16. A method as claimed in claim 1 in which means are provided to prevent the escape of volatile amine.

17. A support carrying an image produced by the method of claim 1.

* * * * *